US006752901B2

(12) United States Patent
Müsse

(10) Patent No.: US 6,752,901 B2
(45) Date of Patent: Jun. 22, 2004

(54) COATING PRESS FOR SHEET-LIKE WORK-PIECES

(75) Inventor: Ludwig Müsse, Horn-Bad Meinberg (DE)

(73) Assignee: Heinrich Wemhoener GmbH & Co. KG, Herford (DE)

( * ) Notice: Subject to any disclaimer, the term of this patent is extended or adjusted under 35 U.S.C. 154(b) by 0 days.

(21) Appl. No.: 10/408,807

(22) Filed: Apr. 7, 2003

(65) Prior Publication Data

US 2003/0188643 A1 Oct. 9, 2003

(30) Foreign Application Priority Data

Apr. 5, 2002 (DE) ..... 102 15 186
Oct. 8, 2002 (DE) ..... 102 46 872

(51) Int. Cl.[7] ..... B30B 5/02

(52) U.S. Cl. ..... 156/583.3; 156/358; 156/580; 156/583.1

(58) Field of Search ..... 156/64, 228, 358, 156/580, 581, 583.1, 583.3

(56) References Cited

U.S. PATENT DOCUMENTS 5,635,014 A * 6/1997 Taylor ..... 156/358
5,788,808 A * 8/1998 Natarajan et al. ..... 156/580
6,645,347 B2 * 11/2003 Stein et al. ..... 156/583.3

FOREIGN PATENT DOCUMENTS

| | | |
|---|---|---|
| DE | 297 08 003 U1 | 10/1998 |
| DE | 199 37 694 A1 | 2/2001 |
| EP | 0 864 414 B1 | 9/1998 |

* cited by examiner

*Primary Examiner*—James Sells
(74) *Attorney, Agent, or Firm*—Laurence A. Greenberg; Werner H. Stemer; Gregory L. Mayback

(57) ABSTRACT

A coating press contains a press frame, press cylinders supported by the press frame, an upper press platen connected to the press cylinders, a lower press platen supported by the press frame, at least one pressure plate, and at least one pressure compensating cushion disposed between the upper press platen or the lower press platen and the pressure plate. The pressure compensating cushion is a hydraulic cushion having a lateral edge closure, a hydraulic medium, and covers including an upper cover and a lower cover. The upper and lower covers along with the lateral edge closure define a pressure-tight inner space filled with the hydraulic medium. A press controller is further provided.

23 Claims, 4 Drawing Sheets

COATING PRESS FOR SHEET-LIKE WORK-PIECES

BACKGROUND OF THE INVENTION

Field of the Invention

The invention relates to a coating press for sheet-like work-pieces. The coating press contains a press frame with press cylinders, an upper and a lower press platen, at least one pressure plate, a pressure compensating cushion disposed between the press platen and the pressure plate, and a press controller.

A plate press for the coating of plate-shaped work-pieces, contains the press frame with press cylinders, the upper and a lower press platen, the pressure plate and the pressure compensating cushion disposed between the press platen and the pressure plate. Such a plate press is known, Published, Non-Prosecuted German Patent Application DE 199 37 694 A1, in which the pressure compensating cushion contains a diaphragm plate and a compensating plate, solid in the cold state, between the diaphragm plate and a heating plate of the plate press. The compensating plate forms, at the pressing temperature, a liquid pressure pad having a predetermined viscosity and thermal conductivity. The known press is intended to have the effect that, with respect to the pressure plate, there is established a homogeneous pressure distribution and minimized pressure plate wear which is usually caused by the deformations of the press platens as a consequence of thermal stresses and by unevennesses of the work-pieces or by their thickness tolerances generated during the manufacturing process.

One disadvantage of the known solution is that the entire press requires fundamental actions and change in order to integrate the pressure compensation cushion into the press platens, this being extremely inefficient. Furthermore, by virtue of such a special construction, the versatility of a press thus equipped is considerably restricted. Also, the diaphragm plate has to be made relatively thick, so as not to bulge out locally in the case of the supporting zones or anchoring heads lying far apart from one another, with the result that the diaphragm plate cannot mate with the surface of the work-pieces. There is, furthermore, a risk that, in the case of very thin and very hard work-pieces to be coated, there will be formed on the work-piece surfaces nests of approximately the size of the area of a hand, which are not completely pressed, so that such work-pieces are only second-rate or even rejects.

SUMMARY OF THE INVENTION

It is accordingly an object of the invention to provide a coating press for sheet-like work-pieces that overcome the above-mentioned disadvantages of the prior art device of this general type, which, along with reduced maintenance intensity, delivers a constantly high-grade working result and which, in particular, is to be capable of compensating small-area unevennesses of the work-pieces. Furthermore, the versatility of the coating press is to be maintained as far as possible.

With the foregoing and other objects in view there is provided, in accordance with the invention, a coating press for sheet-like work-pieces. The coating press contains a press frame, press cylinders supported by the press frame, an upper press platen connected to the press cylinders, a lower press platen supported by the press frame, at least one pressure plate, and at least one pressure compensating cushion disposed between the upper press platen or the lower press platen and the pressure plate. The pressure compensating cushion is a hydraulic cushion having a lateral edge closure, a hydraulic medium, and covers including an upper cover and a lower cover. The upper and lower covers along with the lateral edge closure define a pressure-tight inner space filled with the hydraulic medium. A press controller is further provided. Since the pressure compensating cushion is configured as a hydraulic cushion that has an upper cover, a lower cover and a lateral edge closure, and since the covers and the lateral edge closure surround a pressure-tight inner space which is filled with a hydraulic medium, a pressure compensating cushion is made available which can be exchanged in a simple way for a conventional pressure compensating cushion, without substantial actions on the construction of an existing coating press becoming necessary for this purpose. The hydraulic cushion may also advantageously be used in other types of press, such as multistage presses or film-strip presses. The coating press equipped with such a hydraulic cushion allows isobaric pressure distribution to the work-piece, in spite of thermally induced or weight-induced or pressure-induced bending of the press platens or in spite of the large-area thickness tolerances, caused by the grinding process, of the work-pieces to be coated, of about 1/10–3/10 mm. By virtue of the large-area, close configuration of the supporting profiles, in conjunction with an extremely thin work-piece-side cover, even small-format unevennesses of the work-pieces, which occur, for example, due to faults during the process of grinding chipboards, can be ironed out.

It is advantageous, furthermore, that such a coating press allows a continuous change of format of the work-piece in terms of length and width. Moreover, because of the matability of the work-piece-side cover and the isobaric pressure distribution achieved thereby, the work can be carried out with lower specific pressures, so that, in the case of a new construction of a coating press, the frame plates of the press frame, the press platens, the heating plates and the press cylinders can be produced with lighter weight. The known conventional press cushions can be dispensed with completely or else continue to be used in a substantially thinner form for a much longer period of time. In the case of new coating presses, even counter heating of the press platens may be dispensed with. It could be used, for example, simply for better heat distribution. The extra costs that the hydraulic cushion according to the invention generates are then compensated merely by virtue of the absence of manufacturing costs, piping, regulating systems and control for the counter heating.

Further advantages for the manufacturer using a coating press are reliable production, even in the event of stoppages in the process cycle, and the absence of costs due to the press cushion, the absence of service life monitoring, of the necessary cushion changes and also of pressing-in operations.

The hydraulic cushion can be pressurized under a press platen in a similar way to a normal pressure compensating cushion and can consequently be retrofitted in a simple way even on existing presses.

A further essential advantage is that the hydraulic cushion is not tied to any particular press temperature. It may also be used at temperatures of below 100° C. or even manage completely without heating. The cushion can therefore be used not only in short-cycle presses, what may be referred to as short cycle (SC) plants, but also in all other types of press.

According to a particularly preferred embodiment of the invention, on the covers of a hydraulic cushion are provided inwardly directed supporting profiles which are connected to one another in a form-fitting manner with mutual play in the vertical direction of the covers, so that a maximum travel of the two covers in relation to one another is fixed via the play. This measure prevents the situation where the internal pressure within the hydraulic cushion that occurs due to the surface pressure bulges out where the cushion is not supported by a work-piece or the situation where the pressure plate may bend away at the edge of the work-piece. In order to ensure that the surface of the cover facing the work-piece can nevertheless mate completely with the surface of the latter in a particularly advantageous way, the cover is made thinner than the cover facing away from the work-piece.

An embodiment is particularly advantageous here in which the supporting profiles of both covers have the same height, so that the profiles of one cover bear on the inside on the other cover and thus make available a large-area support of the covers which, in the event of a fault, such as, for example, the loss or escape of the hydraulic medium, can absorb the full pressure force of the press plates.

The stroke limitation of the two covers can be achieved preferably in that the supporting profiles have lateral projections and undercuts, behind which projections and undercuts of adjacent opposite supporting profiles of the other cover engage with play, so that the supporting profiles are interlocked in a form-fitting manner.

Another advantageous stroke limitation may consist of recesses which are introduced into the supporting profiles transversely to these and through which transverse bars are led, the recesses having in the direction of the covers inner dimensions which are greater than the dimensions of the thickness of the transverse bars, so that, even here, a defined play is generated, the amount of which is equivalent to the maximum possible stroke of the two covers.

In order to prevent the situation where work-piece contours of a frequently manufactured size of a work-piece may press into the pressure plate, it is advantageous to dispose the supporting profiles obliquely at an angle to the right-angled covers.

It is advantageous, furthermore, to have the configuration of a compensating vessel or cylinder for the hydraulic medium, which may preferably be a thermally conductive paste which has the advantage of high thermal conductivity and which tolerates the necessary temperatures over a long service life. Since the hydraulic medium used is impressible, the desired tolerance compensation of the thickness gives rise to a change in volume within the hydraulic cushion which would amount to only one liter in the case of a pressing area of, for example 2×5 m and a thickness change of, for example, 1/10 mm.

Advantageously, the compensating cylinder can be acted upon by a regulatable hydraulic pressure, so that, by pressure and quantity regulation of the hydraulic counter pressure, the "elastic spring effect" of the hydraulic cushion and the desired or permissible thickness compensation value can be finely regulated. Furthermore, by such a system, it is advantageously also possible to generate another surface pressure in the coating press, to be precise when the pressure line to the press cylinders is shut off and the surface pressure is generated only by the compensating cylinder being acted upon by the desired pressure. Furthermore, the nature and speed of the buildup and breakdown of the pressing pressure can advantageously be influenced via the pressure-loaded compensating cylinder. Furthermore, via the press controller of the coating press, the tolerance range can advantageously be set continuously via the maximum amount of play. For this purpose, only the pressure on the volume of the hydraulic counter control in the compensating cylinder has to be controlled correspondingly.

The supporting profiles may have, for example, T-shaped, trapezoidal or z-shaped cross sections, in order to ensure the desired task of preventing the bulging out of the covers of the hydraulic cushion. Furthermore, the supporting profiles may advantageously be made massive or else be produced from bent metal sheets. Moreover, the supporting profiles may be welded, riveted or adhesively bonded to the covers or even be shaped in one piece out of the covers or be milled in these.

Use of the hydraulic cushion does not necessary in this case require a conventional pressure compensating cushion to be dispensed with, although the latter, when used with the coating press according to the invention, is exposed to substantially lower wear-promoting conditions. The conventional pressure compensating cushion may in this case continue to serve for compensating the distribution.

According to particular advantageous embodiments of the invention, the press platens may have a divided configuration and consist, for example, of a separate thrust plate, of insulation and of an adjoining heating plate, on the free side of which the hydraulic cushion and, above the latter, a pressure plate are disposed. The hydraulic cushion may in this case also selectively be integrated in the heating plate, a cushion-related acceptance of insulation thickness differences due to manufacture or to continuous load affording the possibility of configuring the heating plate with a minimum possible thickness according to the necessary bore diameter and of optimizing the insulation for the still relatively low surface pressure. The thrust plate itself may be produced, for example, from a steel plate or from a profile structure. This separate construction results in further major advantages of the coating press, such as, for example, on account of the considerably lower mass of the heating plate, a substantially more dynamic regulating behavior and, consequently, more rapid reaction to production interruptions, moreover substantially shorter heating and cooling times, a possible absence of an otherwise necessary counter heating, along with all its components, and, also, thermal insulation of adjacent press components may be dispensed with, since the frame plates, the press cylinders and the hydraulic oil heat up to a lesser extent, and high-pressure insulation of the press cylinders may also be dispensed with. Furthermore, such a configuration also makes it possible to change the heating system, for example to use direct electrical high-current heating, and makes it possible to have a considerable energy saving.

Further advantageous modifications of the coating press have hydraulic cushions which are subdivided into a plurality of sections sealed off relative to one another and which are connected in each case to the separate compensating cylinder, so that individual regions between the press platens can be activated in an optimized manner. Another embodiment has a plurality of separate hydraulic cushions over the surface of a press platen, so that a mutual dependence of adjacent sections of a hydraulic cushion may likewise be ruled out. By virtue of this measure, the cushion can be adapted, for example, to some fixed chipboard dimensions.

Embodiments without compensating vessels or cylinders for the hydraulic medium can likewise be produced and can have, in the inner space of the hydraulic cushion, pressure capsules which, when external pressure is applied, decrease in volume correspondingly. As a further advantageous variant, an embodiment may be considered in which the hydraulic cushion has an edge closure that is elastically deformable, so that volume compensation as a result of the lateral expansion of the edge closure may take place.

In a further advantageous embodiment of the invention, there is disposed between the upper pressure plate and the upper press platen or cushion an additional diaphragm which generates between the pressure plate and the upper press platen a leak-tight space which is connected to a compensating vessel and into which, in the open state of the press and with the pressure plate sagging, a thermally conductive medium can be introduced, which, when pressure acts upon the press, is again displaced fully into the compensating vessel. By virtue of this measure, the pressure plate can be maintained constantly at a desired temperature.

Other features which are considered as characteristic for the invention are set forth in the appended claims.

Although the invention is illustrated and described herein as embodied in a coating press for sheet-like work-pieces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
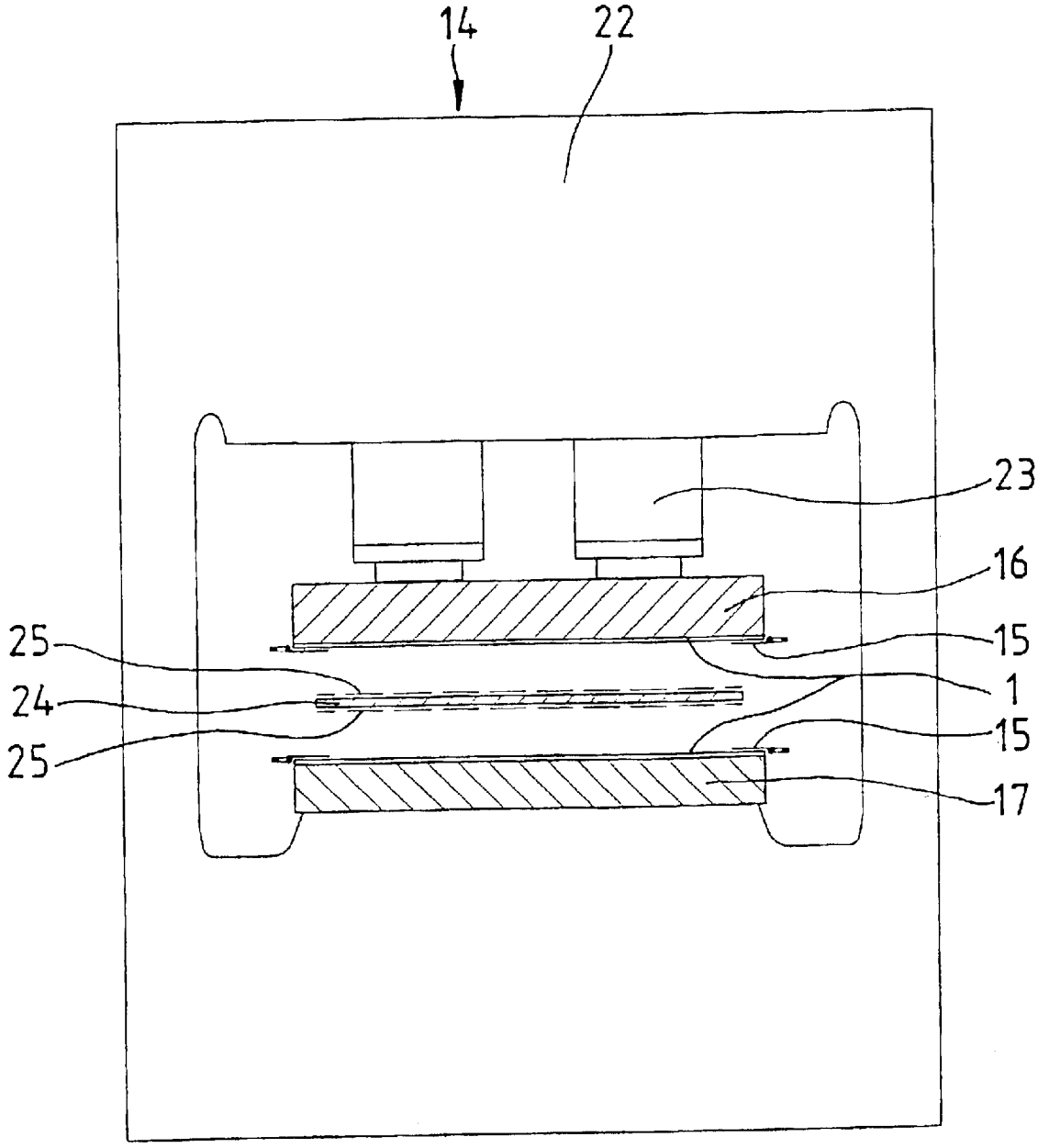
FIG. 1 is a basic diagrammatic, sectional view of a coating press according to the invention.

Referring now to the figures of the drawing in detail and first, particularly, to FIG. 1 thereof, there is shown a coating press 14. The coating press 14 has a press frame 22 composed of frame plates disposed one behind the other and press cylinders 23 which are disposed therein and which act on press platens 16, 17, between which are pressure plates 15 and disposed above them are disposed hydraulic cushions 1. By the coating press 14, a coating material 25 in the form of various papers or films, such as, for example, papers impregnated with melamine resin, can be applied on work-pieces 24, such as, for example, to chipboards, isobarically over the work-piece surface under a relatively high surface pressure and at high temperature. The pressure equality is generated by the hydraulic cushion 1 which is constructed from an upper cover 2, a lower cover 3 and a lateral edge closure 4, which together surround a pressure-tight inner space 5 filled with a hydraulic medium 6 that has a liquid to pasty nature and ensures very good and uniform heat transmission (see FIG. 2). Disposed alternately on the insides of the upper cover 2 and of the lower cover 3 are supporting profiles 7 which are connected to one another so as to limit travel either reciprocally or by further components and which thus restrict the possible stroke of the two covers 2, 3 in opposite directions.

The supporting profiles 7 have the same height and, in the fully compressed state of the two covers 2, 3, bear over a large area on the inside of the opposite cover 3, 2. The supporting profiles 7 have lateral projections 9 and/or undercuts 10. In a pressure-loaded state of the inner space 5, the lateral projections 9 engage behind the undercuts 10 of the adjacent supporting profiles 7 of the other cover 3, 2, while a travel of about 2 mm exist between the two end positions. Tolerances in the work-piece thickness that are around 2/10 mm can thus be reliably absorbed.

Figure 2:
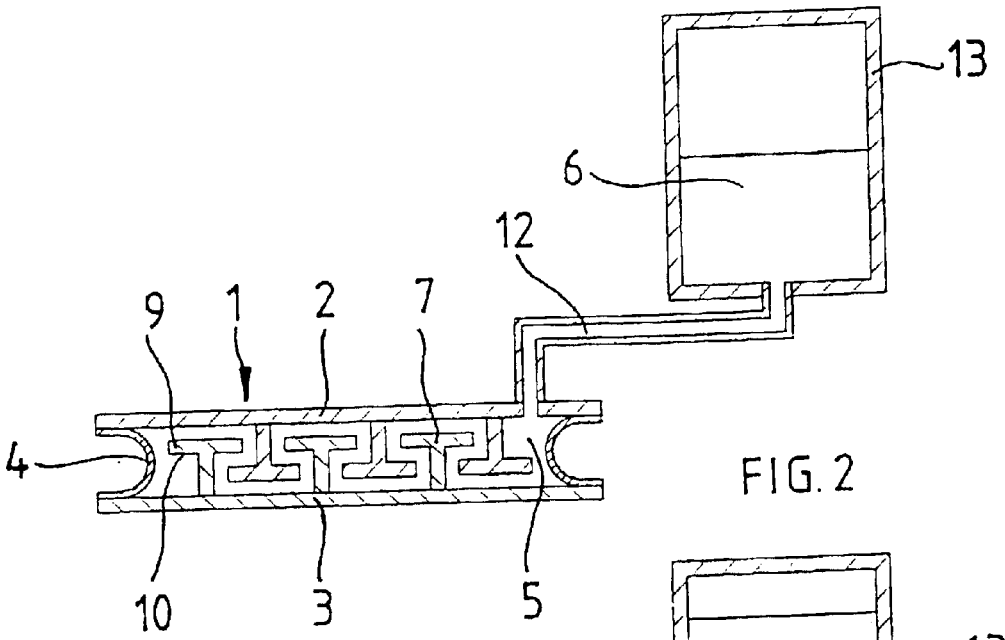
FIG. 2 is a sectional view of a hydraulic cushion in a middle position.
Figure 3:
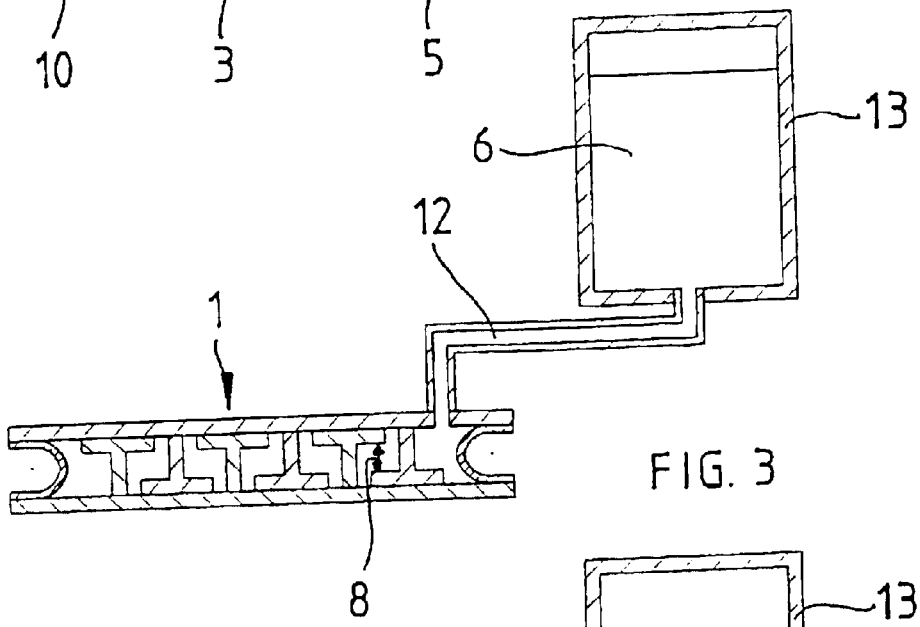
FIG. 3 is a sectional view of the hydraulic cushion according to FIG. 2 in a compressed end position.
Figure 4:
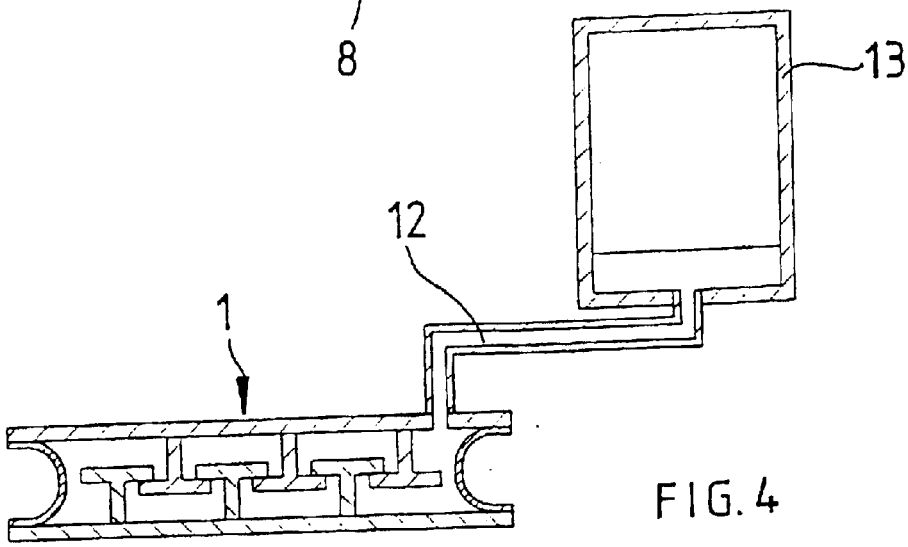
FIG. 4 is a sectional view of the hydraulic cushion according to FIG. 2 in an expanded end position.

As illustrated in FIGS. 2–4, the supporting profile 7 may be configured with a T-shaped cross section and be welded, for example in a region of its standing foot, to the respective cover 2, 3. Interlocking in a maximum deflective position of the two covers 2, 3 prevents a situation where the hydraulic cushion 1 bulges out within the coating press 14 over an area which is not supported by the work-piece 24, thus ruling out the risk that the pressure plate 15 will be bent away at the edge of the work-piece 24.

Figure 7:
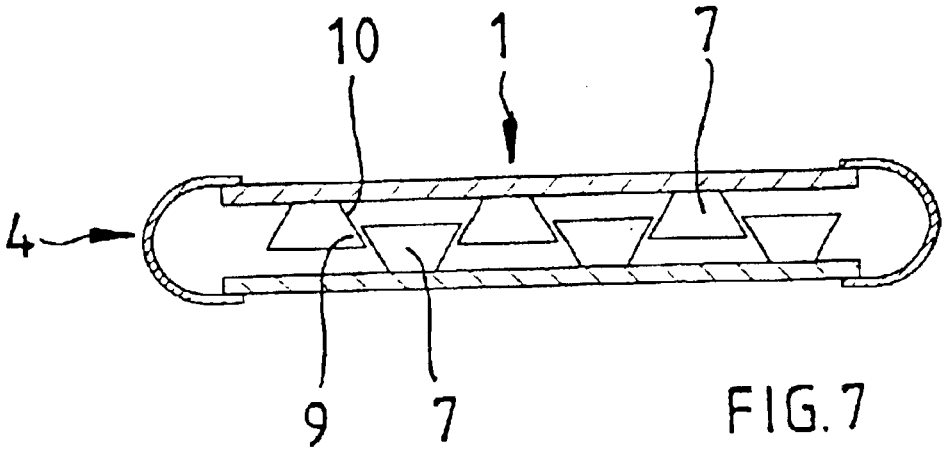
FIG. 7 is a sectional view of a first embodiment of the cushion.
Figure 8:
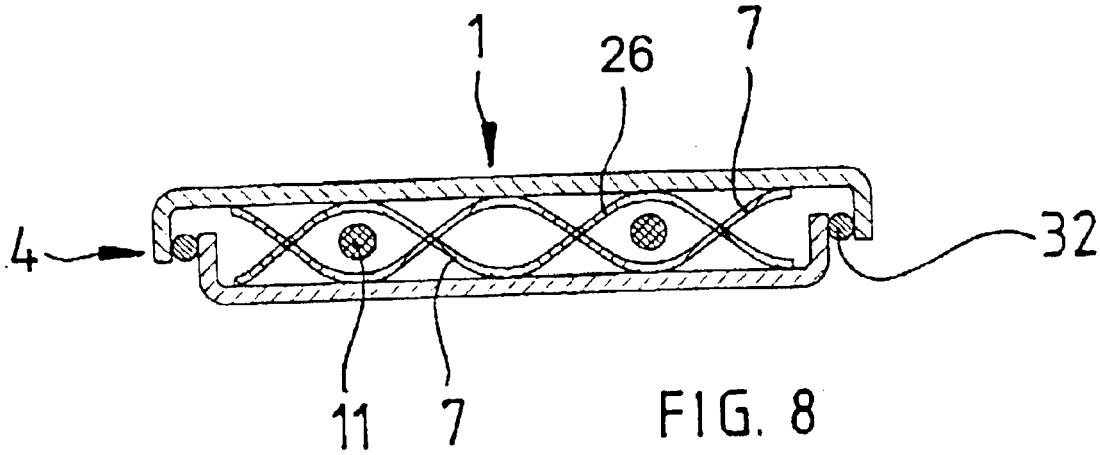
FIG. 8 is a sectional view of a second embodiment of the cushion.
Figure 9:
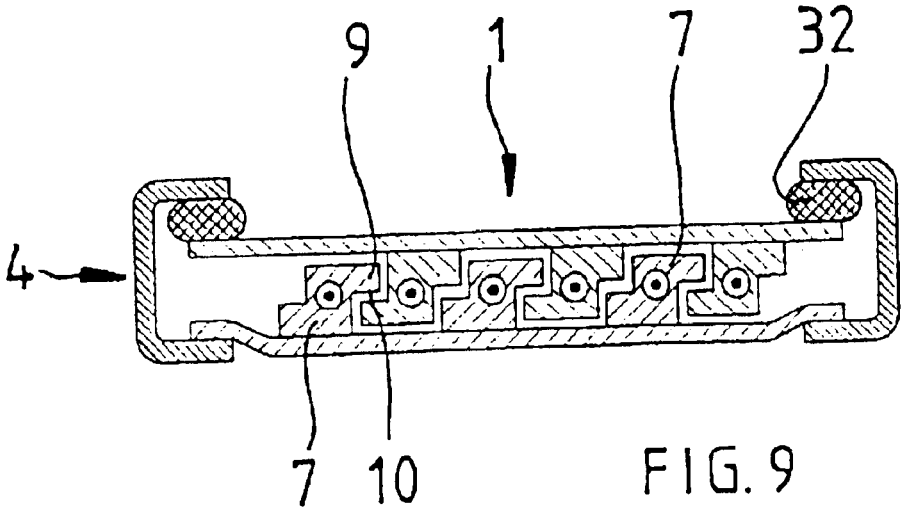
FIG. 9 is a sectional view of a third embodiment of the cushion.

The form-fitting interlock between the involved supporting profiles 7 may be achieved, for example, as illustrated in FIG. 7, via the supporting profiles 7 having a trapezoidal cross section or, as illustrated in FIG. 9, via supporting profiles 7 having an approximately z-shaped cross section. It is also conceivable, as illustrated in FIG. 8, that strips in the manner of corrugated sheets or else trapezoidal or U-shaped sheet metal strips are connected to the covers 2, 3, in which case a transverse bar 11, which brings about a stroke limitation of the hydraulic cushion 1, may extend through the space enclosed between the cover 2, 3 and a sheet metal strip 26.

The drawing does not illustrate versions of supporting profiles 7 formed of simple rectangular profiles which are provided with transverse bores or with long holes which are provided in the direction of movement of the covers 2, 3 and through which extend transverse bars 11 which, in such a version, too, ensure that the hydraulic cushion 1 is held together.

In a further version, not illustrated in the drawing, the supporting profiles 7 are formed of individual chain links which are by U-shaped shackles which may serve as fastening points on the covers 2, 3, in which case either thinner transverse bars extend through the sleeve of chain configured as a sleeve chain or the chain links are equipped with axles which project beyond their width and which are mounted, in turn, in the supporting profiles 7 of the other cover.

Figure 5:
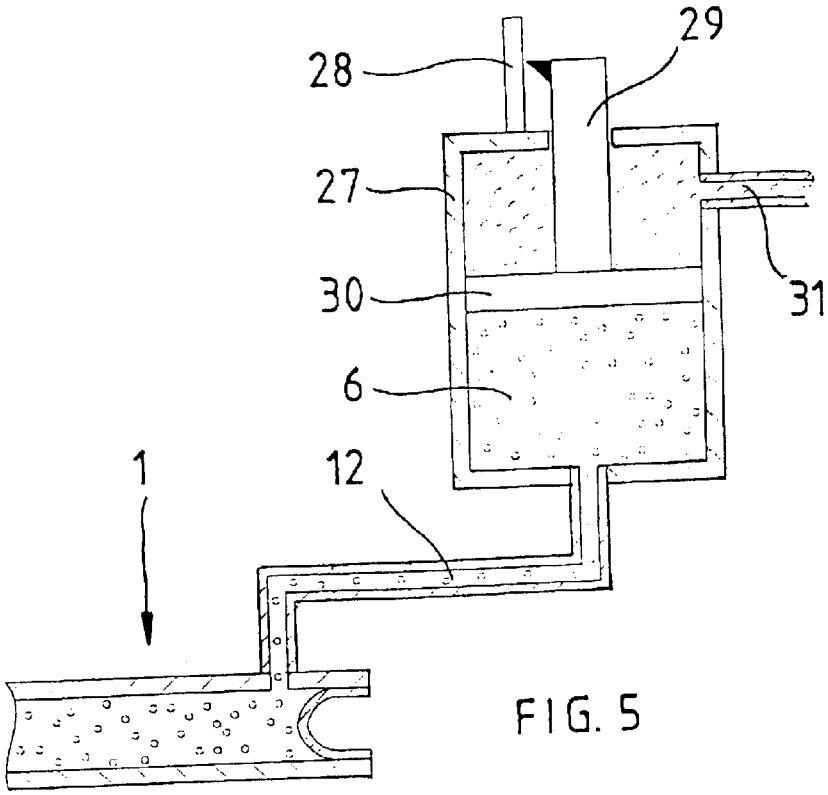
FIG. 5 is a sectional view of a sectional compensating cylinder with a hydraulic counter control.

As illustrated in FIGS. 2–4, a compensating vessel 13 may contain a compressible gas volume or else be configured as a hydraulic cylinder which makes it possible to generate on that side of a hydraulic piston 30 (FIG. 5) which is opposite to the hydraulic medium 6, via a hydraulic control region 31, a hydraulic counter control for controlling the pressure profile in the hydraulic cushion 1. On the hydraulic piston 30 of the compensating vessel 13, a piston rod 29 can be led out of the housing of the compensating vessel 13 and make available an optical travel meter having a fixed scale 28.

The supporting profiles 7 are welded to the covers 2, 3 of the hydraulic cushion 1, but they may also be adhesively bonded or riveted or else, as is not illustrated in the drawing, be shaped in one piece out of the covers, in particular milled in there.

Figure 6:
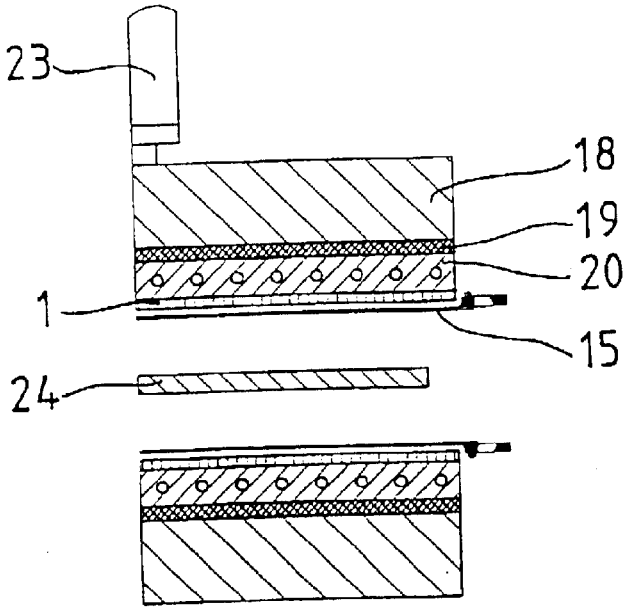
FIG. 6 is a sectional view of a coating press with divided press platens.

As illustrated in FIG. 6, the coating press 14 may be provided with a divided upper and/or lower press platen 16, 17, such a divided press platen 16, 17 being constructed from an upper press plate 18, a separate heating plate 20 and insulation 19 disposed between them, and the heating plate 20 having disposed under it the hydraulic cushion 1 which has adjoining it the pressure plate 15 clamped laterally in the coating press 14.

As illustrated in FIGS. 2–5, the edge closure 4 of the hydraulic cushion 1 may be a metal sheet of U-shaped cross section, curved concavely inward into the inner space 5 of the hydraulic cushion 1 and welded to the upper cover 2 and to the lower cover 3 or, as shown in FIG. 7, by a metal sheet of U-shaped cross section which is shaped concavely outward and which is welded on the outsides to the upper cover 2 and to the lower cover 3, or else by any other embodiments, for example with sealing strips 32 disposed between the upper cover 2 and the lower cover 3 or the edge closure 4.

I claim:

1. A coating press for sheet-like work-pieces, comprising:

a press frame;

press cylinders supported by said press frame;

an upper press platen connected to said press cylinders;

a lower press platen supported by said press frame;

at least one pressure plate;

at least one pressure compensating cushion disposed between one of said upper press platen and said lower press platen and said pressure plate, said pressure compensating cushion being a hydraulic cushion having a lateral edge closure, a hydraulic medium, and covers including an upper cover and a lower cover, said upper and lower covers along with said lateral edge closure define a pressure-tight inner space filled with said hydraulic medium; and a press controller.

2. The coating press according to claim 1, wherein said pressure compensating cushion has supporting profiles disposed on said upper and lower covers and are directed into said pressure-tight inner space, said supporting profiles connected to one another in a form-fitting manner with mutual play in a vertical direction of said upper and lower covers, and a maximum travel of said upper and lower covers in relation to one another is fixed by the mutual play.

3. The coating press according to claim 2, wherein said supporting profiles each have a same height, and in a fully compressed state of said pressure compensating cushion, said supporting profiles of an opposite one of said covers bear on the other cover, and all of said supporting profiles form a large-area support of said upper and lower covers.

4. The coating press according to claim 2, wherein said supporting profiles have lateral projections and undercuts, said lateral projections of one of said supporting profiles disposed on said lower cover engage with play behind said undercuts of an adjacent one of said supporting profiles disposed on said upper cover.

5. The coating press according to claim 2, further comprising transverse bars, said supporting profiles having recesses formed therein disposed parallel to said covers, said transverse bars being led through said recesses, a dimension of said recesses in a direction of said covers being greater than a dimension of a thickness of said transverse bars for defining an extent of the mutual play.

6. The coating press according to claim 2, wherein said covers are right-angled covers and said supporting profiles are disposed at an angle to said right-angled covers.

7. The coating press according to claim 1, further comprising:

a compensating vessel storing said hydraulic medium; and a connecting line connecting said compensating vessel for said hydraulic medium to said pressure-tight inner space.

8. The coating press according to claim 7, wherein said compensating vessel can be acted upon by pressure and, via a nature and magnitude of the pressure, a specific pressure and a nature of a buildup and breakdown of a pressing pressure can be influenced via said press controller.

9. The coating press according to claim 7, wherein a tolerance range can be set continuously within a maximum amount of the mutual play by said press controller.

10. The coating press according to claim 2, wherein said supporting profiles have a T-shaped, trapezoidal or z-shaped cross section.

11. The coating press according to claim 2, wherein said supporting profiles are manufactured from bent metal sheets.

12. The coating press according to claim 2, wherein said supporting profiles are one of welded, riveted and adhesively bonded to said covers.

13. The coating press according to claim 2, wherein said supporting profiles are chain links having U-shaped shackles as contact surfaces contacting insides of said covers.

14. The coating press according to claim 2, wherein said supporting profiles are produced in one piece with said covers.

15. The coating press according to claim 2, further comprising a mechanical cushion layer disposed between said hydraulic cushion and said pressure plate.

16. The coating press according to claim 1, wherein at least one of said upper and lower press platens has a divided configuration and is formed of a thrust plate, an insulation layer, and a heating plate, on a free first side of said divided configuration, a said hydraulic cushion is disposed and, on a second side of said divided configuration said pressure plate is disposed.

17. The coating press according to claim 1, further comprising:

compensating vessels storing said hydraulic medium; and connecting lines connecting said compensating vessels for the hydraulic medium to said pressure-tight inner space, said hydraulic cushion is subdivided into a plurality of sections that are sealed off relative to one another and are in each case connected to a separate one of said compensating vessels.

18. The coating press according to claim 1, wherein said hydraulic cushion is one of a plurality of separate hydraulic cushions, said hydraulic cushions are disposed on each of said upper and lower press platens over an area of said upper and lower press platens.

19. The coating press according to claim 1, further comprising pressure capsules disposed in said hydraulic medium in said pressure-tight inner space for providing volume compensation.

20. The coating press according to claim 1, wherein said lateral edge closure is configured elastically and volume compensation takes place by an expansion of said lateral edge closure.

21. The coating press according to claim 1, further comprising:

a compensating vessel; and a diaphragm disposed between said pressure plate and said upper press platen, said diaphragm generating between said pressure plate and said upper press platen a leak tight space that is fluidically connected to said compensating vessel and into said leak tight space, in an open state of the coating press and with said pressure plate sagging, a thermally conductive medium can be introduced.

22. The coating press according to claim 1, wherein said lower cover facing a work-piece is made thinner than said upper cover facing away from the work-piece.

23. The coating press according to claim 2, wherein said supporting profiles have lateral projections and undercuts, said lateral projections of one of said supporting profiles disposed on said upper cover engage with play behind said undercuts of an adjacent one of said supporting profiles disposed on said lower cover.

* * * * *